US006942211B2

(12) United States Patent
Teo et al.

(10) Patent No.: US 6,942,211 B2
(45) Date of Patent: Sep. 13, 2005

(54) MOBILE PRINTER AND PAPER FEEDER

(75) Inventors: Cherng Linn Teo, Singapore (SG); Ah Chong Tee, Singapore (SG); Mylene Angele Kit-Njoek Tjin Wong Joe, Singapore (SG); Dennis Chua, Singapore (SG)

(73) Assignee: Hewlett-Packard Development Company, LP, Houston, TX (US)

( * ) Notice: Subject to any disclaimer, the term of this patent is extended or adjusted under 35 U.S.C. 154(b) by 96 days.

(21) Appl. No.: 10/619,063

(22) Filed: Jul. 11, 2003

(65) Prior Publication Data

US 2005/0006835 A1 Jan. 13, 2005

(51) Int. Cl.[7] ..... B65H 1/00
(52) U.S. Cl. ..... 271/145; 271/162; 271/171
(58) Field of Search ..... 271/171, 162, 271/145, 188, 3.14, 9.01, 9.09; 347/104; 400/605, 642, 646, 647, 647.1

(56) References Cited

U.S. PATENT DOCUMENTS 5,105,210 A * 4/1992 Hirano et al. ..... 346/145
5,648,807 A * 7/1997 Saito et al. ..... 347/102
5,931,456 A 8/1999 Laidlaw
5,975,521 A * 11/1999 Ono et al. ..... 271/188
6,042,106 A * 3/2000 Kelly et al. ..... 271/188
6,082,730 A * 7/2000 Campbell et al. ..... 271/171
6,131,899 A * 10/2000 Nojima et al. ..... 271/121
6,213,464 B1 * 4/2001 Inoue et al. ..... 271/248
6,315,285 B1 11/2001 Brugger et al.
6,796,556 B2 * 9/2004 Robertson et al. ..... 271/84
2002/0063374 A1 * 5/2002 Takahashi ..... 271/10.01
2002/0067944 A1 6/2002 Lee et al.
2004/0017459 A1 * 1/2004 Kawaguchi et al. ..... 347/104
2004/0150703 A1 * 8/2004 Nojima et al. ..... 347/104

* cited by examiner

*Primary Examiner*—David H. Bollinger

(57) ABSTRACT

A mobile, color printer capable of printing on letter-size plain paper and standard-size photo paper has a fold-up paper feeder that acts as a cover during travel. Such also serves as a storage tray for several sheets of paper to allow automatic feeding from a vertical stack. A slotted door hinged to the back of the printer, and under the hinges for the fold-up paper feeder/cover, can be flipped up or down. In the down position, a slot on the right side guides the user to feed in photo paper in the correct location. In the up position, letter-size plain paper has full-width access to the printing mechanism, and a sliding adjustable guide on the left allows letter, A4, and other size papers to be lightly corralled on both sides.

7 Claims, 4 Drawing Sheets

MOBILE PRINTER AND PAPER FEEDER

FIELD OF THE INVENTION

The present invention relates generally to printers, and more specifically, to paper feeding mechanisms and methods for mobile printers.

BACKGROUND OF THE INVENTION

Various sizes of paper have become standardized throughout the world for various print jobs. In the United States, business is routinely conducted with "letter" size paper, e.g., 8.5"×11". In the past, the legal profession used "legal" sized paper, e.g., 8.5"×14". In Europe, so-called "A4" is used which is a bit narrower and a little longer than "letter" sized paper. Photographs have standardized on 8"×10", Hagaki, and 4"×6" print sizes. So a commercial necessity has emerged for printers that can handle all the common sizes of paper now in use.

Large, desktop printers have the luxury of having interchangeable paper trays that can be specialized for each paper size. Some paper trays have adjustable fences that allow different widths of paper to be loaded in a cassette. But small, mobile printers have no slide-in cassette trays at all, and rely on a manual or gravity feed of paper from the top.

Conventional printers can lay a lot of ink on a photo paper printout, and such ink can require a few extras seconds to dry and resist smudging. When more than one photo paper sheet is being printed, the later sheets output can smudge the top ones in the output stack. So it helps if the later sheets are gently dropped flat on the stack.

SUMMARY OF THE INVENTION

Briefly, a printer embodiment of the present invention is a mobile, color printer capable of printing on letter-size plain paper and standard-size photo paper. A fold-up paper feeder acts as a cover during travel, and as a storage tray for several sheets of paper to allow automatic feeding from a vertical stack. A slotted door hinged to the back of the printer, and under the hinges for the fold-up paper feeder/cover, can be flipped up or down. In the down position, a slot on the right side guides the user to feed in photo paper in the correct location. In the up position, letter-size plain paper has full-width access to the printing mechanism, and a sliding adjustable guide on the left allows letter, A4, and other size papers to be lightly corralled on both sides.

An advantage of the present invention is that a printer is provided that is easily portable.

Another advantage of the present invention is that a printer is provided that can accommodate various sizes of paper and photo card stock.

A further advantage of the present invention is that a printer is provided that is inexpensive to produce.

DETAILED DESCRIPTION OF THE EMBODIMENTS

Figure 1A:
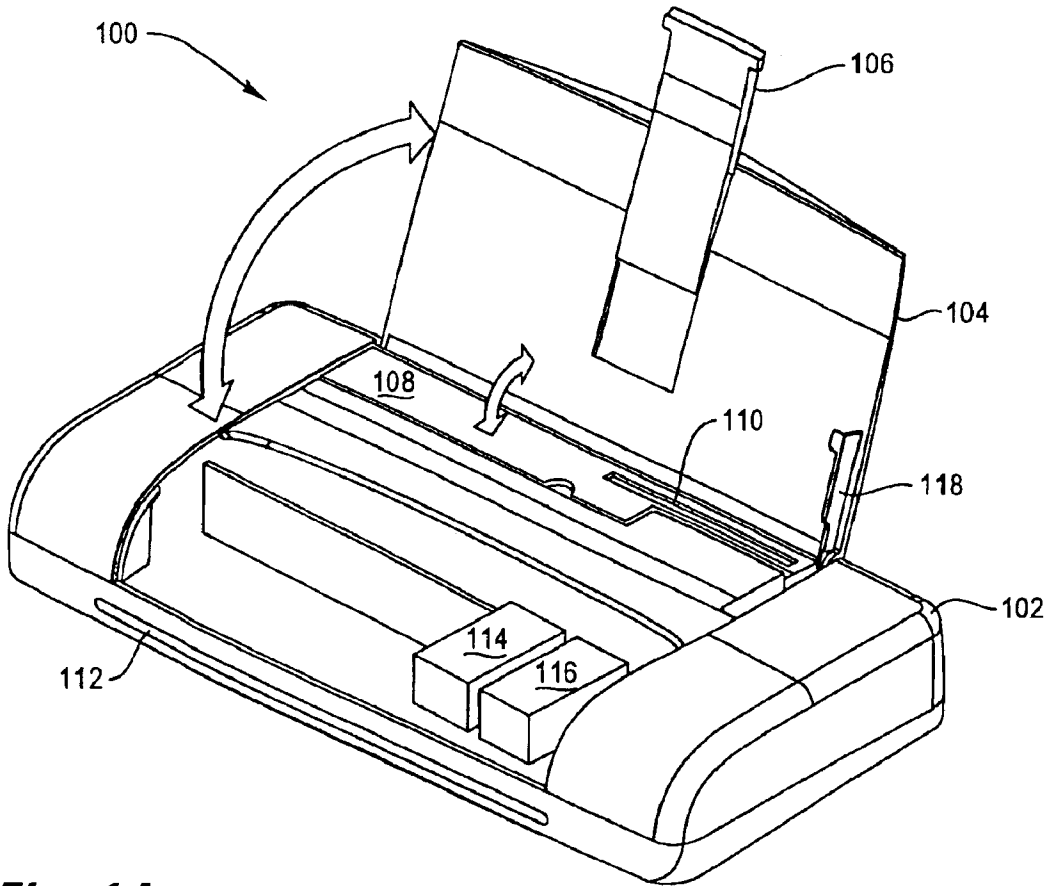
FIG. 1A is a perspective view of a mobile printer embodiment of the present invention showing its paper feeder/cover open, the paper support arm extended, and the photo-paper door gate folded down so the user has to feed photo paper through the slot.

FIG. 1A represents a mobile printer embodiment of the present invention, and is referred to herein by the general reference numeral 100. In one embodiment, the mobile printer 100 is generally about 13.3"×3.2"×6.5" and weighs about 4.2 pounds. It is capable of portable, battery powered operation. The mobile printer 100 includes a base 102 to which is hinged a paper-feeder/cover 104. In the closed position, the printer can be conveniently carried. Mobile printer 100 can accommodate plain and coated paper, labels, transparencies, Hagaki, card stock, envelopes, banner, and photo paper.

A paper support 106 can be extended to support the free end of paper loaded in the paper-feeder/cover 104. A hinged door 108 has a slot 110 that allows Hagaki or other photo papers to be fed in at an optimum offset from the right edge. This offset allows printing to commence much closer to the right edge of the photo paper, and it helps the stiffer photo paper to avoid a curling device inside before a paper output slot. Such curling device curls up the left and right edges of plain bond letter size paper so the paper will cantilever out while being output, and helps prevent smearing of a previously discharged page. A color ink cartridge and inkjet printhead 114 and a black ink cartridge and inkjet printhead 116 move left and right across the paper feeding-through during each print job. A right-edge guide 118 is visible and is in a fixed position. However, the right edge of slot 110 is offset to the left from this, and the slot controls how far to the right a photo paper can be loaded in.

Figure 1B:
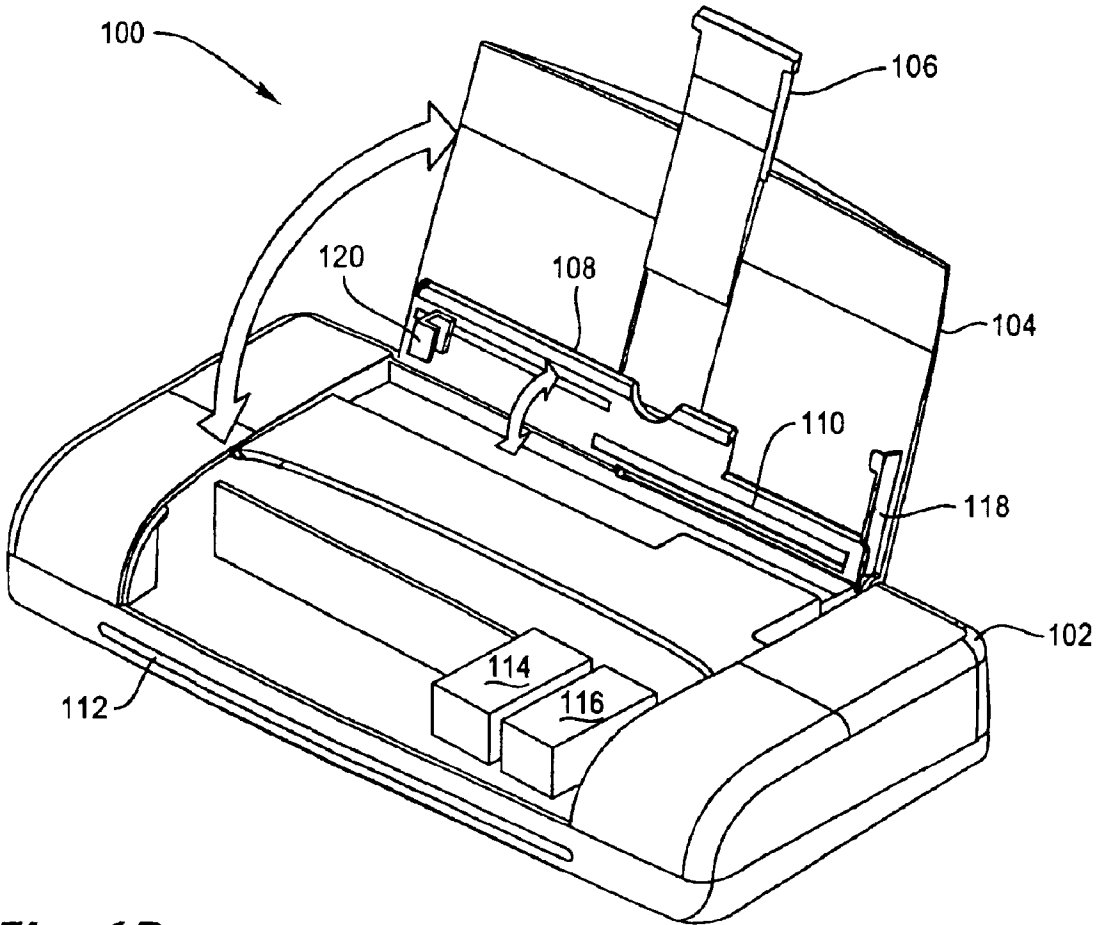
FIG. 1B is a perspective view of the mobile printer of FIG. 1A showing its paper feeder/cover open, the paper support arm extended, and the photo-paper door gate folded up so the user can load letter-sized paper between the adjustable guide on the left and the fixed guide on the right.

In FIG. 1B, the hinged door 108 has been flipped up to get it out of the way for the printer to receive, e.g., plain-bond letter-size paper. An adjustable left-side guide 120 can now be seen. It is slide-mounted to the underside of the hinged door 108 and is used to lightly corral the left edge of the papers being input. The left-side guide 120 is preferably adjustable to accommodate at least letter-size paper sheets, A4-size paper sheets, and envelopes. The right-side fixed paper guide 118 lightly corrals in the right edge of such papers being input. The slot 110 no longer limits access to the printing zone beneath because it is folded up out of the way.

Figure 1C:
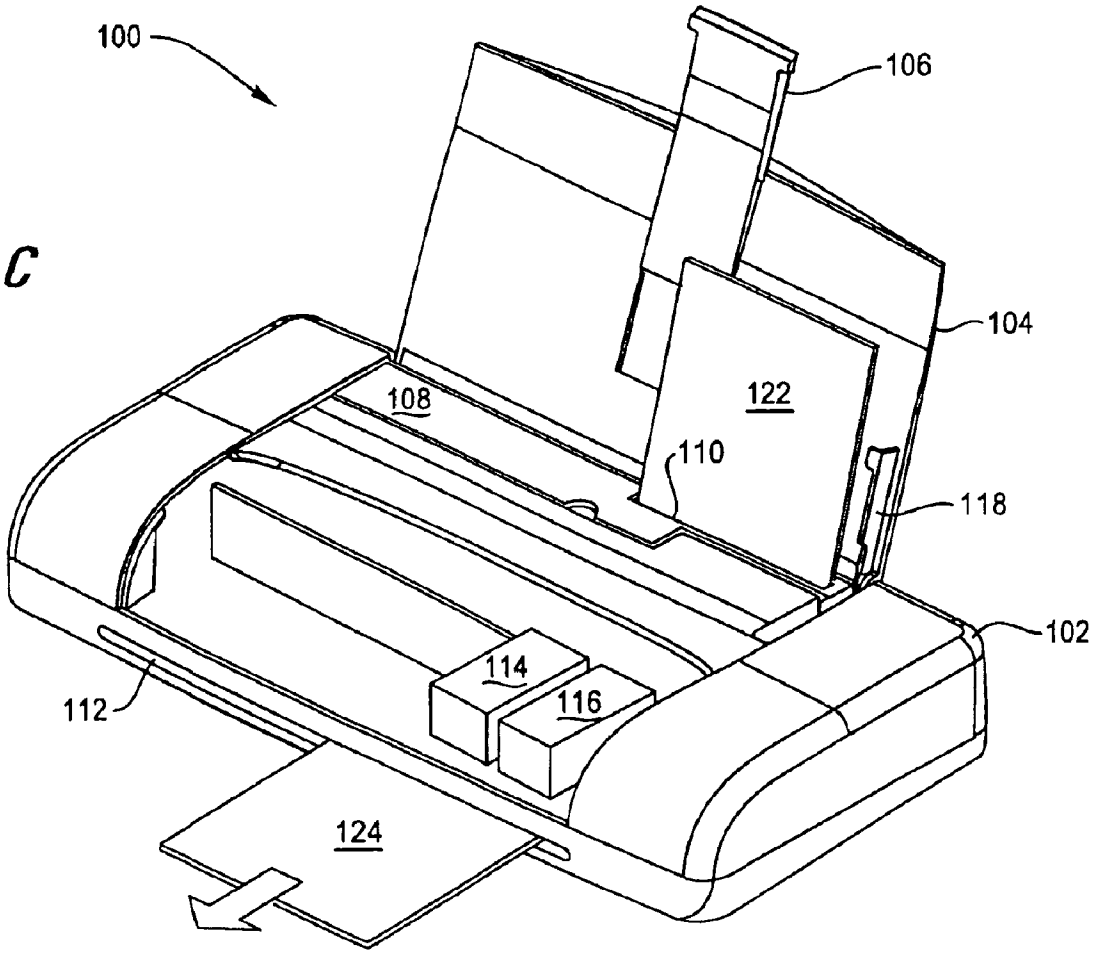
FIG. 1C is a perspective view of the mobile printer of FIG. 1A showing photo-paper being fed through the slot in the door gate, and another piece of printed photo-paper being output from the front.

In FIG. 1C, a Hagaki or 4"×6" piece of photo paper 122 is shown as feeding through the slot 110. The finished, printed output is represented by a sheet 124.

Figure 1D:
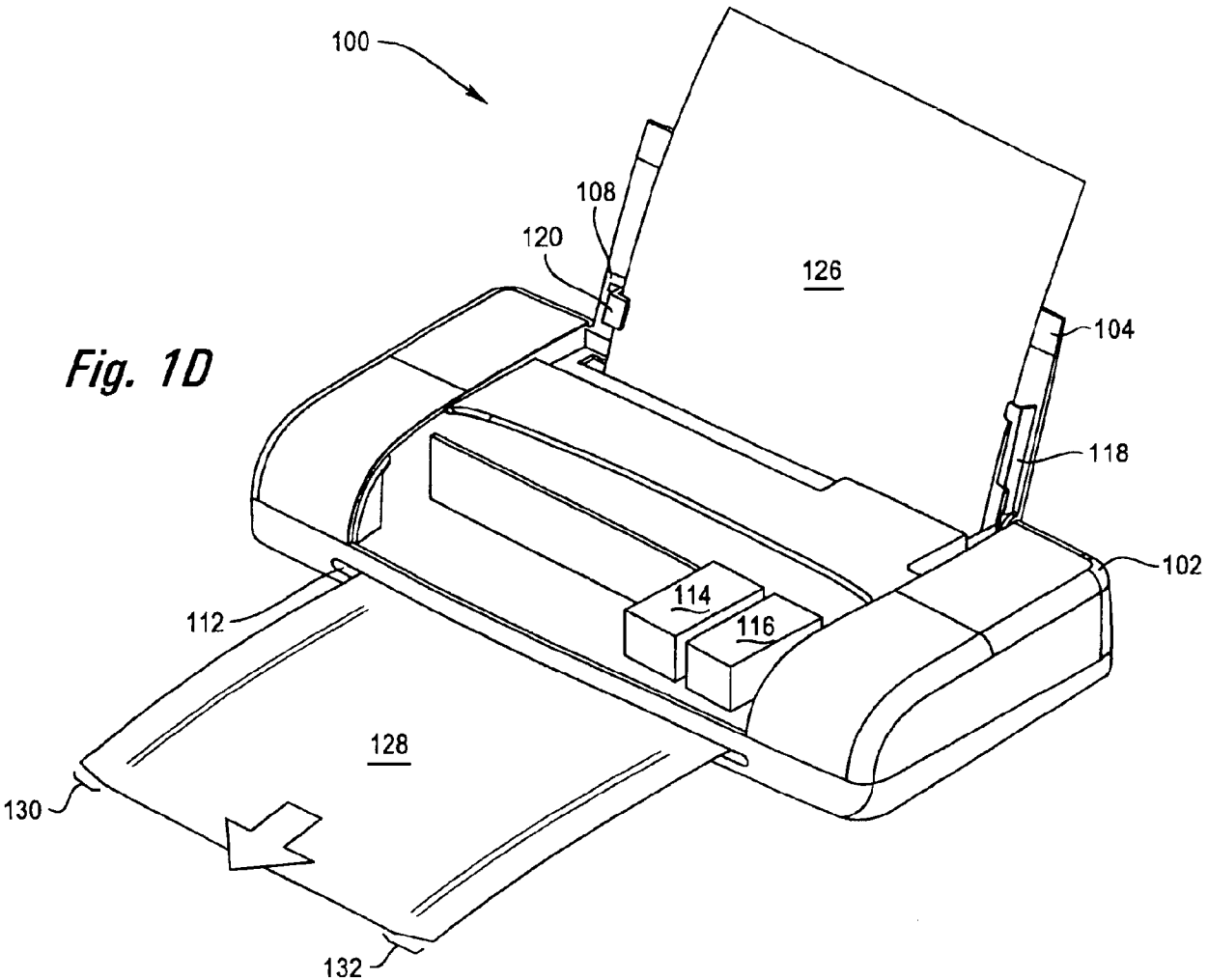
FIG. 1D is a perspective view of the mobile printer of FIG. 1B showing letter-sized paper being fed with the door gate opened and out of the way, and with the adjustable guide on the left set for this sized paper, and another piece of paper being output from the front after printing.

In FIG. 1D, a letter-size sheet of paper 126 is shown as feeding directly into the printer with the door 108 folded up and the adjustable left side guide 120 properly set. The output is represented by a sheet 128 that has had its edges 130 and 132 curled up. Such curling is impressed on sheet 128 by a pair of curling lifts inside output slot 112.

In an alternative embodiment of the present invention, the pair of curling lifts inside output slot 112 are articulated such that they retract when door 108 is folded down to receive the Hagaki or 4"×6" piece of photo paper 122. Such photo paper is usually stiffer than bond paper 126, so the curling lifts are unnecessary. They can also significantly increase the force needed to output sheet 124 if not retracted.

The print media referred to herein includes plain paper, envelopes, coated paper, photo or glossy paper, transparency, card stock, index card, photo card, post card, hagaki card, labels, iron-on transfers, and any other suitable print media. Print media sizes useable with embodiments of the present invention include:

A4 (210 mm × 297 mm),
A5 (148 mm × 210 mm),
A6 Card (105 mm × 148 mm),
B5 (182 mm × 257 mm),
executive (7.25" × 10.5"), legal (8.5" × 14"),
letter (8.5" × 11"),
index card (3" × 5"),
photo/post card (4" × 6"),
Hagaki card (100 mm × 148 mm),
6-3/4 envelope (3.25" × 6.5"),
7-3/4 envelope (3.875" × 7.5"),
#9-envelope (3.875" × 8.9"),
#10-envelope (4.125" × 9.5"),
A2 baronial (111 mm × 146 mm),
B5 envelope (176 mm × 250 mm),
C5 envelope (162 mm × 229 mm),
C6 envelope (114 mm × 162 mm),
DL envelope (110 mm × 220 mm) and
custom sizes (Up to 8.5" × 17", 216 mm × 432 mm).

Although the present invention has been described in terms of the presently preferred embodiments, it is to be understood that the disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. A mobile printer, comprising:

a printing mechanism for printing on a plurality of sizes of papers and sheet medias;

an enclosure in which the printing mechanism is disposed;

a hinged cover attached to the top rear of the enclosure and movable between a closed position and an open position, the cover in the open position providing for access of said plurality of sizes of papers and sheet medias to be input from the top to said printing mechanism;

a hinged door positioned between the hinged cover and the printing mechanism and capable of being flipped up when the hinged cover is open to allow a sheet of paper from a stack to enter; and a slot disposed in the hinged door and providing for a limitation of the size and position that photo paper can enter the printing mechanism when the hinged door is flipped down, said photo paper being of lesser width than said sheet of paper.

2. The printer of claim 1, further comprising:

a fixed right-side guide attached underneath the hinged cover and that provides a reference right-edge to align said sheet of paper from said stack while entering.

3. The printer of claim 2, wherein:

a right side of the slot is offset to the left of the fixed right-side guide to control how far to the right the photo paper can be loaded into the printer.

4. The printer of claim 1, further comprising:

an adjustable left-side guide attached underneath the hinged door and that provides a reference left-edge to align said sheet of paper from said stack while entering.

5. The printer of claim 1, wherein:

the hinged cover serves as both a paper sheet stacking tray in the open position and an enclosure cover in the closed position.

6. The printer of claim 1, wherein:

the printer provides for an edge curling of said sheet of paper that enables a cantilevering during print job output, wherein smudging of still-wet inks on previous sheets of paper output is reduced.

7. A method for printing various sizes of papers in a printer, comprising:

providing a printing mechanism for printing on a plurality of sizes of papers and sheet medias;

disposing said printing mechanism inside an enclosure;

attaching a hinged cover to the top rear of said enclosure, said hinged cover being movable between a closed and an open position, the cover in the open position providing for access of said plurality of sizes of papers and sheet medias to be input from the top to said printing mechanism;

positioning a hinged door between said hinged cover and printing mechanism for being flipped up when the hinged cover is open to allow a sheet of paper from a stack to enter; and disposing a slot in the hinged door to provide for a limitation of the size and position that a photo paper can enter said printing mechanism when said hinged door is flipped down, said photo paper being of lesser width than said sheet of paper.

* * * * *